US006331071B2

(12) United States Patent
Akamine et al.

(10) Patent No.: US 6,331,071 B2
(45) Date of Patent: Dec. 18, 2001

(54) STIRRING DEVICE

(75) Inventors: Shoko Akamine, Tokyo; Yasunao Miyazawa; Shigenobu Maruoka, both of Urawa, all of (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 09/795,123

(22) Filed: Mar. 1, 2001

Related U.S. Application Data

(63) Continuation of application No. 09/437,152, filed on Nov. 10, 1999.

(30) Foreign Application Priority Data

Nov. 11, 1998 (JP) ..... 10-321085
May 21, 1999 (JP) ..... 11-142394

(51) Int. Cl.[7] ..... B01F 7/18
(52) U.S. Cl. ..... 366/325.92; 366/329.1; 366/293
(58) Field of Search ..... 366/325.92, 35.5, 366/307, 343, 329.1, 293

(56) References Cited

U.S. PATENT DOCUMENTS

| | | | |
|---|---|---|---|
| 1,129,158 | 2/1915 | Babek | 366/325.92 |
| 2,289,645 | 7/1942 | Geistert | 366/325.92 |
| 2,520,540 | 8/1950 | Green | 366/325.5 |
| 4,365,897 | 12/1982 | Amorese et al. | 366/343 |
| 4,444,510 | 4/1984 | Janssen | 366/307 |
| 4,728,731 | 3/1988 | Raehse | 366/307 |
| 5,399,014 | 3/1995 | Takata et al. | 366/325.92 |

FOREIGN PATENT DOCUMENTS

| | | | |
|---|---|---|---|
| 2 289 645 | 7/1942 | (DE) | 366/325.92 |
| 4 728 731 | 3/1988 | (DE) | 366/307 |
| 61-200842 | 9/1986 | (JP) . | |
| 5-49890 | 3/1993 | (JP) . | |
| 7-124456 | 5/1995 | (JP) . | |

*Primary Examiner*—Tony G. Soohoo
(74) *Attorney, Agent, or Firm*—Finnegan, Henderson, Farabow, Garrett & Dunner, L.L.P.

(57) ABSTRACT

A stirring device achieving high stirring efficiency and easy to wash and maintain, is provided. The stirring device includes a vertical cylindrical stirring vessel, a rotary shaft vertically extended within the stirring vessel for rotation, and a stirring vessel constituted of two or more basically rectangular vane plates vertically supported on the rotary shaft in symmetrical relation with each other with respect to the rotary shaft. On an upper portion of the stirring vane, a recess is formed for forming a cone about the rotary shaft when the stirring vane rotates. A lower end of the stirring vane is arranged in the vicinity of a bottom surface of the stirring vessel.

4 Claims, 5 Drawing Sheets

STIRRING DEVICE

This is a continuation of application Ser. No. 09/437,152, filed Nov. 10, 1999 incorporated herein by reference.

This application is based on Japanese Patent Application Nos. 10-321085 (1998) filed Nov. 11, 1998 and 11-142394 (1999) filed May 21, 1999, the contents of which are incorporated hereinto by reference.

BACKGROUND OF THE INVENTION

1. Field of the Invention

The present invention relates generally to a stirring device. More particularly, the invention relates to a stirring device suitable for use in processing, such as mixing, dissolving, dispersing or so on of medium or high viscous fluid or the like, in a chemical industry, a pharmaceutical industry, a food industry and so on.

2. Description of the Related Art

Conventionally, a stirring device including a stirring vessel, a rotary shaft rotatably supported within the stirring vessel and stirring vanes fixed on the rotary shaft for rotation within the stirring vessel, has been widely used in fields of a chemical industry, a pharmaceutical industry, a food industry or the like. Amongst, as typical stirring devices to be used for process, such as mixing, dissolving, dispersing or so on of medium or high viscous fluid or the like, stirring devices having helical ribbon vanes, anchor vanes or the like have been used.

The helical ribbon vane is a stirring vane which forces a liquid to be stirred to circulate vertically and in conjunction therewith to prevent the liquid to be stirred from stagnating near an inner peripheral wall of a container, by tilting the vanes.

On the other hand, the anchor vane having a vane diameter substantially equal to a diameter of the vessel is advantageous in the case where a peripheral interface layer is disturbed or solid is deposited on the peripheral surface. Therefore, it is suitable for stirring a high viscous fluid or crystallizing operation.

Moreover, as recent technologies, (1) Japanese Patent Application Laid-open No. 61-200842 (1986) discloses a stirring device which has a stirring shaft carrying a bottom paddle arranged in a bottom portion of a vessel in sliding contact with a bottom wall surface of the stirring vessel and a grid vane located above the bottom paddle and constituted of an arm portion and a strip extending perpendicularly from the arm portion, and a plurality of baffle plates provided on a side wall surface of the stirring vessel and aligned in an axial direction from the lower portion to the upper portion in a spaced apart relationship.

Also, (2) Japanese Patent Application Laid-open No. 5-49890 (1993) discloses a stirring device which has a rotary shaft extending vertically at the center portion within a vertical-cylindrical stirring vessel, mounting a plurality of rectangular paddle vanes in multiple stages in a vertical direction, and placing the lowermost paddle vane advanced in a rotating direction with respect to the lower stage paddle vane vertically adjacent with the lowermost paddle vane in a cross axis angle less than 90°.

Furthermore, (3) Japanese Patent Application Laid-open No. 7-124456 (1995) discloses a stirring device which comprises a vertical cylindrical stirring vessel, a stirring shaft extending vertically to a center in the stirring vessel for rotation from outside of the stirring vessel, a plurality of upper vanes mounted on the stirring shaft, formed in the form of trapezoid-shape and having a recess in the lower center portion, lower vanes mounted perpendicularly to the upper vanes, formed into rectangular shape and having a recess in the upper center portion, and backwardly slanting vanes coupled with the lower vanes integrally or separately, slanted in a reverse direction relative to a rotating direction and formed with cut-out portions symmetrically positioned about the stirring shaft.

However, among such conventional stirring devices, the stirring device having the helical ribbon vane and the stirring device having the anchor vane may encounter a problem that a doughnut-ring-like not well mixed portion can be generated in stirring at a particular rotation speed depending on a nature of fluid as contents.

It should be noted that the stirring devices (1) to (3) above encounter the following problems. The stirring device of (1) employing the bottom vane and grid vane has a low withdrawal effect at the upper center portion. The stirring device of (2) employing a plurality of rectangular paddle vanes and the stirring device of (3) employing generally trapezoidal vane tend to partially interfere an upward flow from the lower side of the stirring vanes by a discharge flow from the upper side of the stirring vanes to hinder optimal stirring.

In the recent year, according to progress of increasing of kinds of products to be manufactured and reducing of the number of products to be manufactured in one lot, a demand for a higher performance and wider variation in the stirring device has been growing. Namely, there has been required a stirring device which can achieve a high stirring efficiency, can be easily washed and maintained and has smaller mechanical load. However, none of the conventional stirring devices can satisfy such requirements.

SUMMARY OF THE INVENTION

The present invention has been worked out to satisfy the foregoing demand. It is therefore an object of the present invention to provide a stirring device which can promote an upward flow from a lower side of a stirring vane and build-up a vertical circulation flow in an axial direction by controlling a discharge flow from an upper side of the stirring vane in stirring of a fluid having medium or high viscosity with simple construction, so as to achieve optimal stirring, and which has a high stirring efficiency at low rotation speed and power consumption and can be easily washed and maintained.

There is provided a stirring device comprising:

a vertical cylindrical stirring vessel;

a rotary shaft vertically extended within the stirring vessel for rotation; and a stirring vane constituted of two or more basically rectangular vane plates vertically supported on the rotary shaft in symmetrical relation with each other with respect to the rotary shaft, wherein a recess is formed in an upper portion of the stirring vane so as to form a cone about the rotary shaft when the stirring vane rotates and a lower end of the stirring vane is arranged in the vicinity of a bottom surface of the stirring vessel.

Here, a height of the recess may be greater than or equal to one fifth and less than or equal to four fifth of an overall height of the stirring vane, and a maximum width of the recess may be greater than or equal to one fifth and less than or equal to four fifth of an maximum width of .a body of rotation of the stirring vane about the rotary shaft.

A height of the recess may be greater than or equal to one half and less than or equal to two third of an overall height of the stirring vane, and a maximum width of the recess may be greater than or equal to one half and less than or equal to two third of an maximum width of a body of rotation of the stirring vane about the rotary shaft.

A stirring device may further comprise a rectangular baffle plate disposed between an outer edge portion of the stirring vane and an inner peripheral surface of the stirring vessel.

A rectangular cut-out may be formed in an upper portion of an outer edge portion of the stirring vane.

The stirring vane may be a multi-stage vane including an upper vane and a lower vane.

The above and other objects, effects, features and advantages of the present invention will become more apparent from the following description of embodiments thereof taken in conjunction with the accompanying drawings.

BRIEF DESCRIPTION OF THE DRAWINGS

FIGS. 5A to 5D are illustrations showing comparison of results in decoloring experiments, wherein FIG. 5A shows a result of decoloring experiment in the first embodiment of the stirring device according to the present invention, FIG. 5B shows a result in the conventional stirring device with the generally trapezoidal vane (without baffle plates), FIG. 5C shows a result of decoloring experiment in the second embodiment of the stirring device according to the present invention, and FIG. 5D shows a result in the conventional stirring device with the generally trapezoidal vane (with baffle plates).

DETAILED DESCRIPTION OF THE PREFERRED EMBODIMENT

Figure 1:
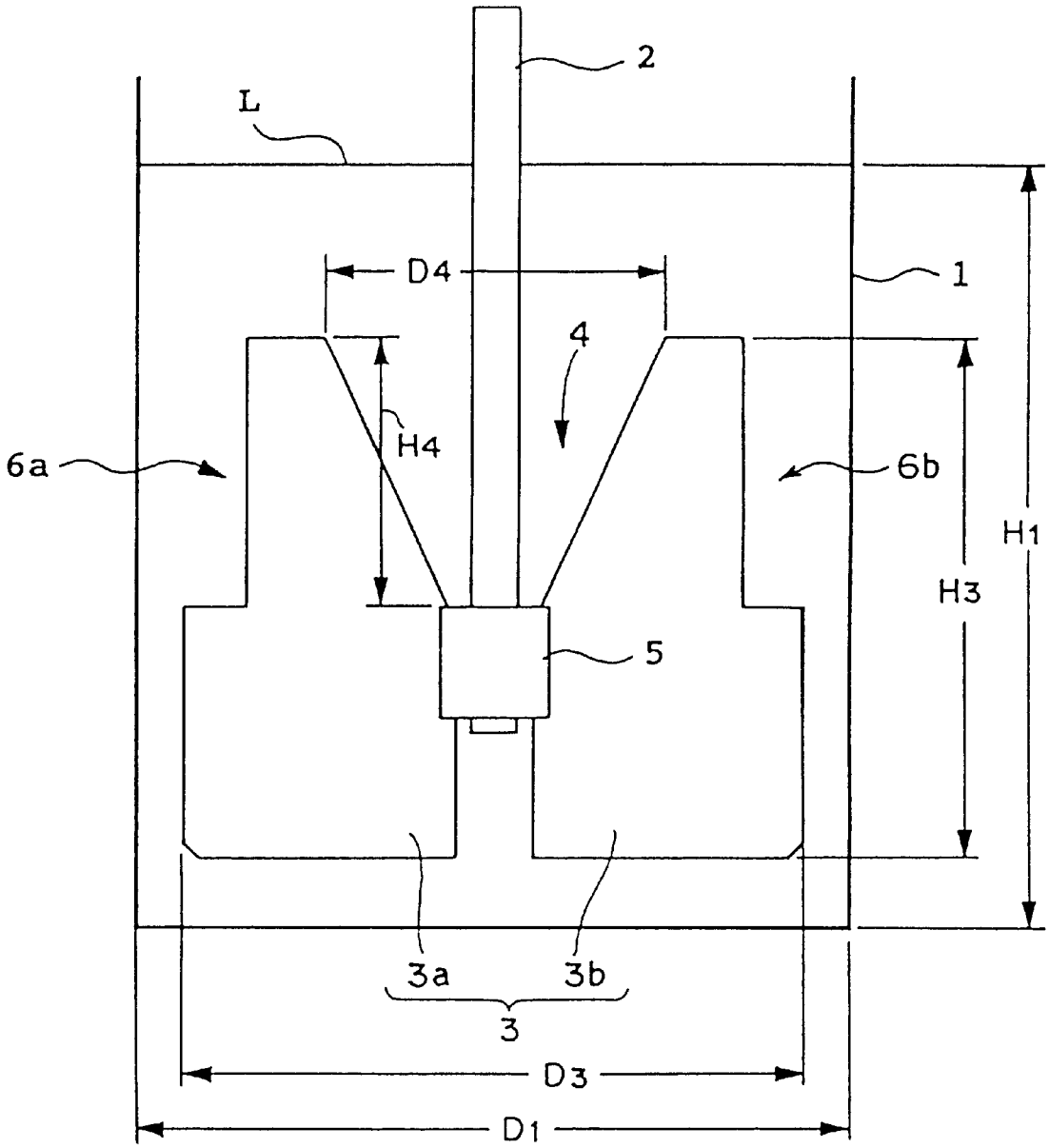
FIG. 1 is a side elevation showing the first embodiment of a stirring device according to the present invention.

The best mode of the present invention will be explained hereinafter in detail in terms of preferred embodiments illustrated in the accompanying drawings. It should be noted that the embodiments disclosed hereinafter are not intended to be taken limitative to the present invention but for explanation and understanding only. It should be further noted that like reference numeral will be used throughout the disclosure and drawings to identify like functional part or portion.

FIG. 1 shows the first embodiment of a stirring device according to the present invention.

In FIG. 1, reference numeral 1 denotes a vertical cylindrical stirring vessel having a bottom, 2 denotes a rotary shaft vertically extended within the stirring vessel 1 for rotation, 3 denotes a stirring vane constituted of two basically rectangular vane plates 3*a* and 3*b* vertically supported on the rotary shaft 2 via a boss 5 in generally symmetric relationship with respect to the rotary shaft 2. In the upper inner portion of the stirring vane 3, a generally V-shaped recess 4 is formed by obliquely cutting out the upper edges of the vane plates 3*a* and 3*b* so that a turning cone is formed about the rotary shaft when the stirring vane 3 is rotated together with the rotary shaft 2. On the other hand, in the upper portions of the outer edges of the vane plates 3*a* and 3*b* forming the stirring vane 3, rectangular cut-outs 6*a* and 6*b* are formed, respectively. The lower edge of the stirring vane 3 is arranged in the vicinity of and in substantially parallel to a bottom surface of the stirring vessel 1. Reference character L denotes a liquid surface of a fluid.

Here, when a height from the bottom surface of the stirring vessel 1 to liquid surface L is assumed as an effective height $H_1$ of the stirring vessel 1, overall height $H_3$ of the stirring vane 3 is preferred to be about ⅔ of the effective height $H_1$ of the stirring vessel 1. On the other hand, a maximum width (rotational diameter) $D_3$ of a rotary body about the rotary shaft 2 of the stirring vane 3 is preferred to be about ⅘ of a diameter $D_1$ of an inner periphery of the stirring vessel 1.

On the other hand, a height $H_4$ of the generally V-shaped recess 4 is greater than or equal to ⅕ and less than or equal to ⅘ of the overall height $H_3$ of the stirring vane 3. The maximum width $D_4$ (rotational diameter) of the turning cone about the rotary shaft 2 of the recess 4 is preferred to be greater than or equal to ⅕ and less than or equal to ⅘ of the maximum width $D_3$ of the stirring vane 3. Furthermore, the height $H_4$ of the recess 4 is greater than or equal to ½ and less than or equal to ⅔ of the overall height $H_3$ of the stirring vane 3. The maximum width $D_4$ of the recess 4 is further preferably greater than or equal to ½ and less than or equal to ⅔ of the maximum width $D_3$ of the stirring vane 3.

Then, a distance between the lower end of the stirring vane 3 and the bottom surface of the stirring vessel 1 is made as small as possible, and is preferred to be less than or equal to ⅒ of the effective height $H_1$ of the stirring vessel 1.

Figure 2:
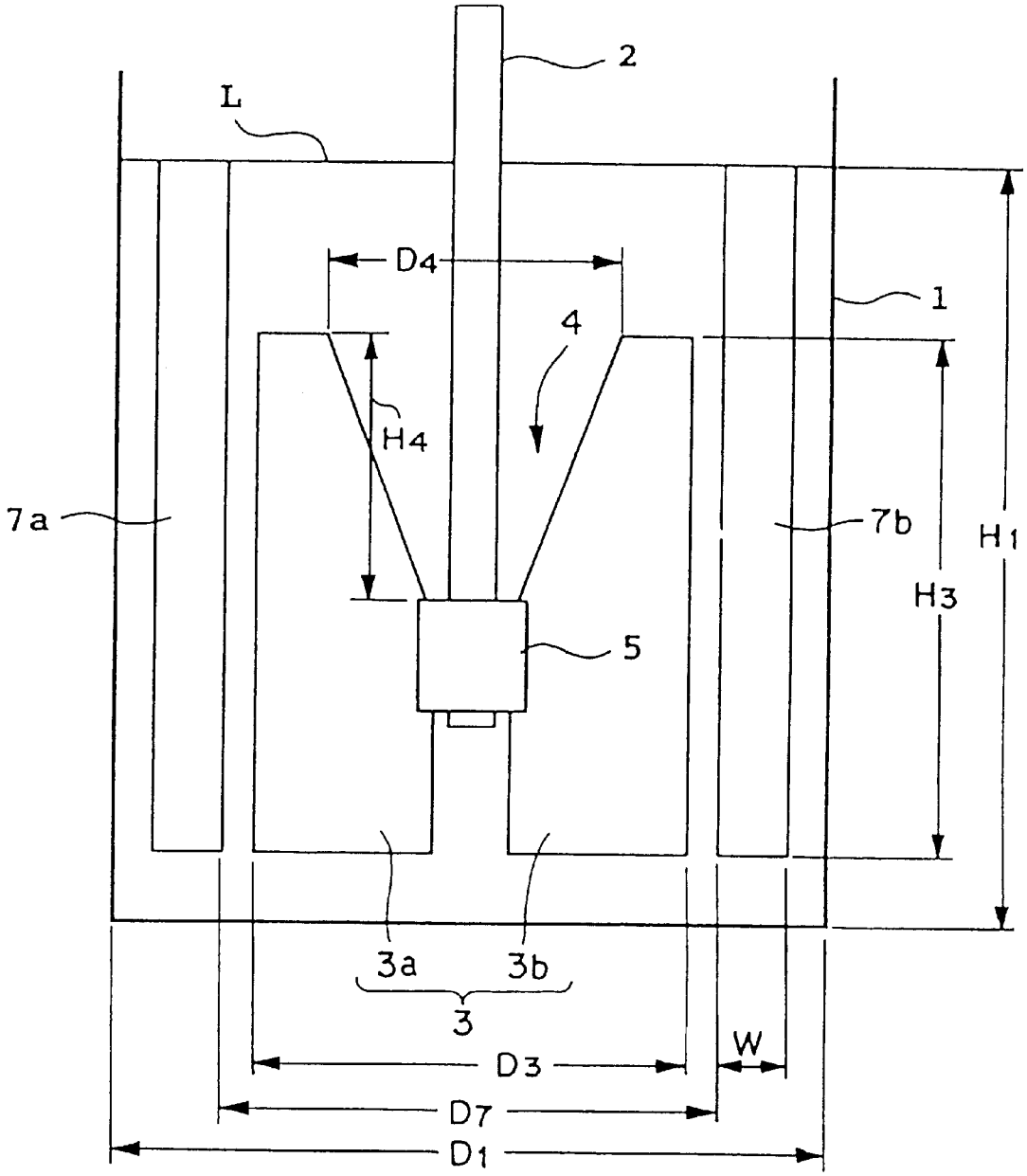
FIG. 2 is a side elevation showing the second embodiment of a stirring device according to the present invention.

Next, FIG. 2 shows the second embodiment of the stirring device according to the present invention.

As shown in FIG. 2, even in the second embodiment, the stirring device includes the vertical cylindrical stirring vessel 1, the rotary shaft 2 vertically extending within the stirring vessel 1 for rotation, and the stirring vane 3 constituted of two basically rectangular vane plates 3*a* and 3*b* supported on the rotary shaft 2 via the boss 5 vertically in a symmetric relationship with respect to the shaft 2, and the generally V-shaped recess 4 is formed by obliquely cutting out the upper inner edges of the vane plates 3*a* and 3*b* so that the turning cone is formed about the rotary shaft 2 when the stirring vane 3 is rotated together with the rotary shaft 2, similarly to the first embodiment set forth above. However, in the shown embodiment, the rectangular cut-out is not formed in the upper portions of the outer edges of the vane plates 3*a* and 3*b* forming the stirring vane 3, and in place, rectangular baffle plates 7*a* and 7*b* are arranged symmetrically with respect to the rotary shaft between the outer edge of the stirring vane 3 and the inner peripheral surface of the stirring vessel 1. The lower end of the stirring vane 3 is located in the vicinity of and in substantially parallel to the bottom surface of the stirring vessel 1 similar to the first embodiment set forth above.

When a height from the bottom surface of the stirring vessel 1 to the liquid surface L is an effective height $H_1$ of the stirring vessel 1, overall height $H_3$ of the stirring vane 3 is preferably about ⅔ of the effective height $H_1$ of the stirring vessel 1. Also, the maximum width $D_3$ of a rotary body about the rotary shaft 2 of the stirring vane 3 is preferably about ⅘ of a diameter $D_7$ of an inscribed circle of the baffle plates 7*a* and 7*b*.

On the other hand, a width W of the baffle plates 7*a* and 7*b* are about 1/10 of a diameter $D_1$ of the stirring vessel 1, respectively. Also, a preferred relative dimensional relationship between the generally V-shaped recess 4 and the stirring vane 3 is the same as that of the first embodiment.

Figure 3:
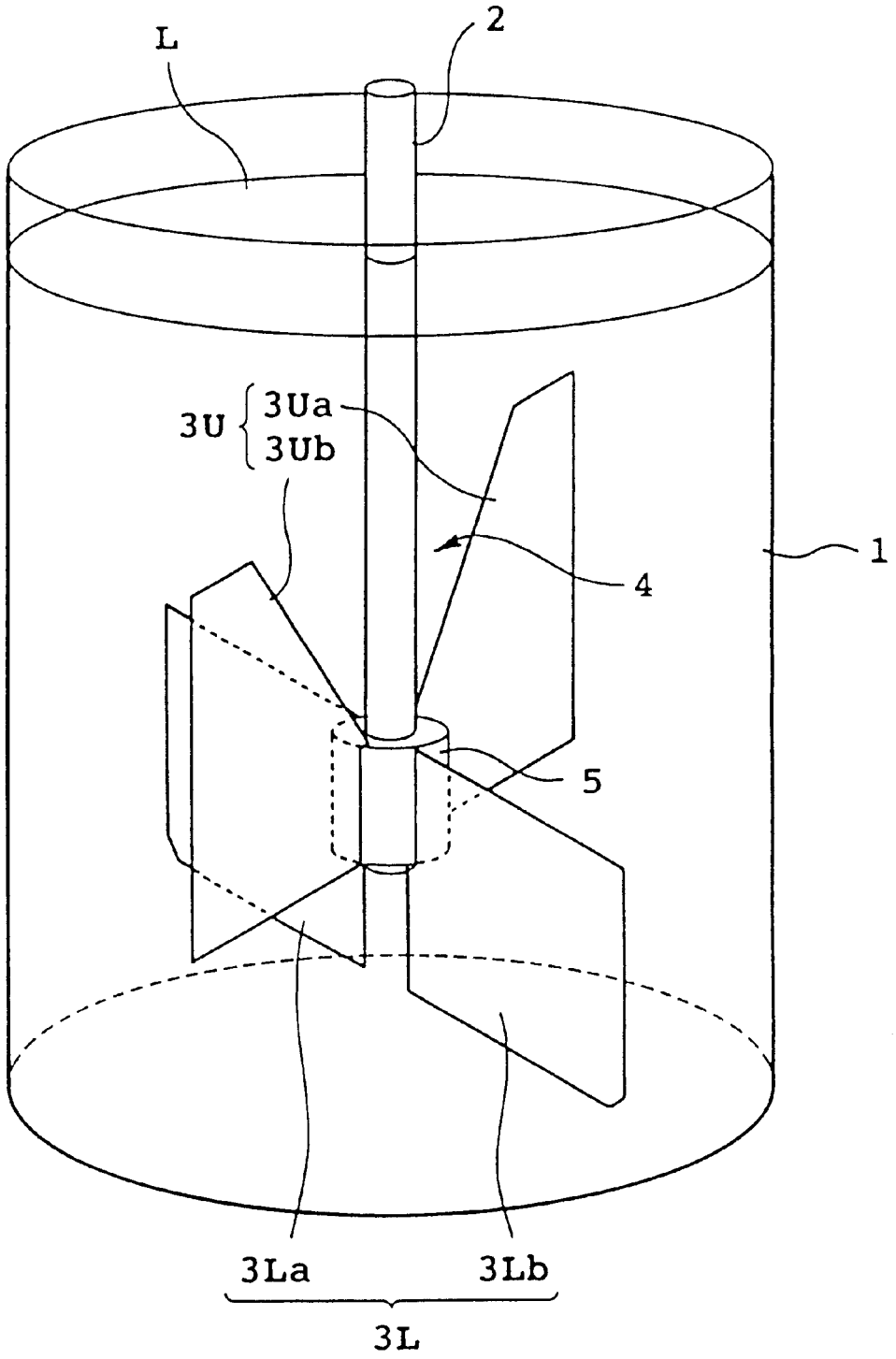
FIG. 3 is a perspective view showing the third embodiment of a stirring device according to the present invention.

Next, the third embodiment of the stirring device according to the present invention will be explained with reference to FIG. 3.

In the third embodiment, the stirring vane 3 in the first and second embodiments are arranged in multiple stages including an upper vane and a lower vane.

Namely, an upper vane 3U is constituted of two basically rectangular vane plates 3U*a* and 3U*b* supported on the rotary shaft 2 via the boss 5 vertically in a symmetric relationship with respect to the shaft 2, and a generally V-shaped recess 4 is formed by obliquely cutting out the upper inner edges of the vane plates 3U*a* and 3U*b* so that a turning cone is formed about the rotary shaft 2 when the stirring vane 3U is rotated together with the rotary shaft 2.

A lower vane 3L constituted of two basically rectangular vane plates 3L*a* and 3L*b* supported on the rotary shaft 2 via the boss 5 vertically in a symmetric relationship with respect to the shaft 2. The lower vane 3L is positioned in an axial direction so as to overlap with the upper vane 3U to the extent corresponding to the axial length of the boss 5, and is oriented for an angular offset relative to the upper vane 3U at an angle of about 90°.

Similarly to the foregoing first and second embodiments, the lower end of the lower vane 3L is positioned in the vicinity of and in substantially parallel to the bottom surface of the stirring vessel 1.

Here, the preferred relative dimensional relationship between the stirring vessel 1 and the upper and lower vanes 3U and 3L and preferred relative dimensional relationship between the generally V-shaped recess 4 and the upper and lower vanes 3U and 3L are similar to those between the stirring vessel 1 and the stirring vane 3 in the first and second embodiments, so that the term "stirring vane 3" in the first and second embodiments may be replaced with "the upper vane 3U and the lower vane 3L".

Next, operation of the preferred embodiments of the present invention will be explained. In general, the stirring device generates rotational flow of the fluid in the stirring vessel about the rotary shaft by rotation of the vane plates vertically held on the rotary shaft. Then, the fluid tends to be discharged in radial directions by centrifugal force generated by rotational flow thereof. Next, due to pressure gradient in the vertical direction caused by the rotational flow of the fluid, flow in the axial direction is generated.

In the foregoing embodiments of the stirring devices according to the present invention, owing to the presence of the recess 4 in the upper portion of the stirring vane 3 (upper vane 3U in the third embodiment), a vertical pressure gradient is easily generated in the vicinity of the inner peripheral surface of the side wall of the stirring vessel 1. Also, owing to the presence of the recess 4 in the upper portion of the stirring vane 3, rotational velocity of the fluid in the portion of the recess and centrifugal force to be generated by the rotation are reduced. As a result, discharge flow in the radial direction caused by the upper portion of the stirring vane 3 (upper vane 3U in the case of the third embodiment) can be suppressed. Furthermore, in the first embodiment, owing to the presence of rectangular cut-outs 6*a* and 6*b* formed in the upper portion of the outer edge of the vane plates 3*a* and 3*b* of the stirring vane 3, discharge flow in the radial direction caused by the upper portion of the stirring vane 3 is further suppressed. By suppression of the discharge flow in the radial direction, conversion of a downward flow in the vicinity of the rotary shaft 2 from the portion near the liquid surface L into the discharge flow in the radial direction by the upper half portion of the stirring vane 3 (upper vane 3U in the case of the third embodiment) can be suppressed. Thus, the downward flow in the vicinity of the rotary shaft 2 continuously flows through the lower half portion of the stirring vane 3 (lower vane 3L in the case of the third embodiment) and thereafter is converted into the discharge flow in the radial direction. As a result, a vertical circulating flow in the axial direction can be further grown.

Figure 4B:
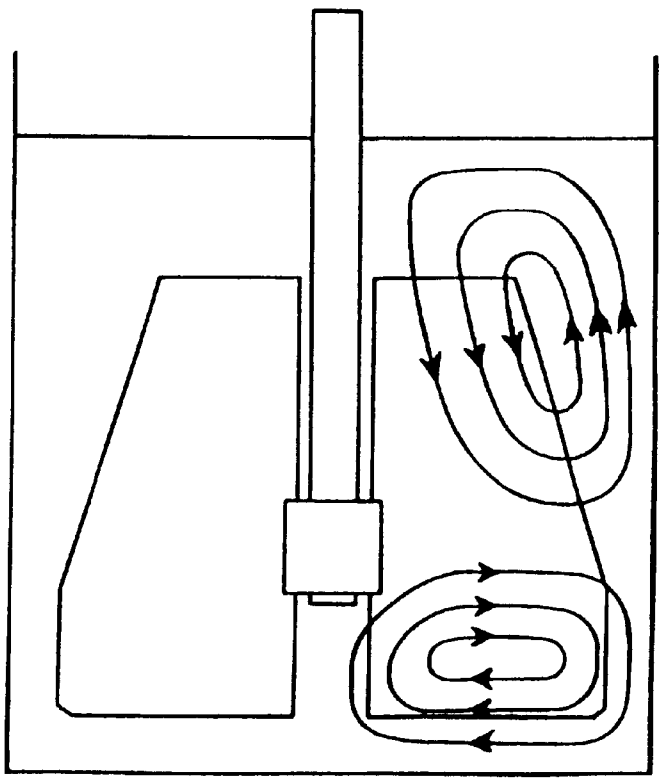
FIG. 4B PRIOR ART
FIGS. 4A and 4B are diagrammatic illustrations respectively showing results of fluid flow analysis (flow line group) in the first embodiment of the stirring device according to the present invention and the conventional stirring device with generally trapezoidal stirring vane.
Figure 4A:
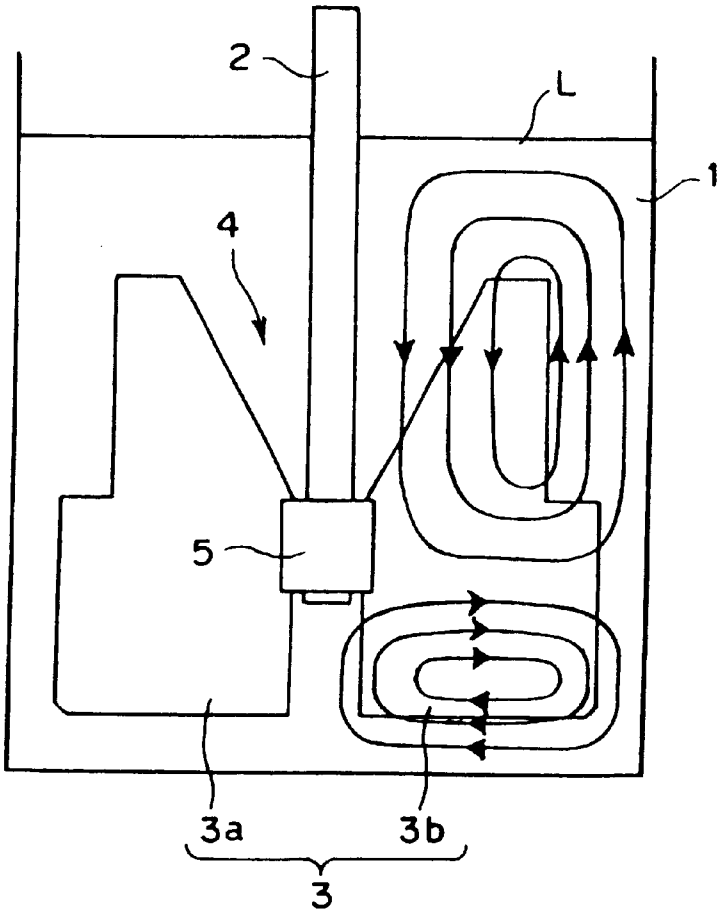

Among the preferred embodiments of the present invention, a result of a fluid flow analysis of the first embodiment of the stirring device as a typical embodiment is illustrated comparing with that of the conventional stirring device with the generally trapezoidal vane, in FIGS. 4A and 4B. In the case of the stirring device employing the stirring vane formed with the generally V-shaped recess 4 in accordance with the present invention, a flow line group in the upper portion within the stirring vessel 1 is close to a rectangular flow group (see FIG. 4A). In contrast to this, in the case of the stirring device of the conventional generally trapezoidal vane, the flow line group is close to an elliptic flow group (see FIG. 4B). As can be seen from FIGS. 4A and 4B, an aspect ratio of generally rectangular flow line group in the former in the vicinity of the center is large, whereas an aspect ratio of the generally elliptic flow line group in the latter in the vicinity of the center is small. Furthermore, the center of the former flow line group is placed within a range of the vane plate, whereas the center of the later flow line group is out of the range of the vane plate. If the center of the flow line group is maintained within the range of the vane plate, not well mixed portion may not be generated. Conversely, when the center of the flow line group is out of the range of the vane plate, doughnut-ring-like not well mixed portion can be generated. Namely, it can be appreciated that the stirring device according to the present invention can achieve a flow pattern optimal for mixing owing to the vertical pressure gradient.

Thus, in the stirring device according to the present invention, owing to the presence of the generally V-shaped recess 4 in the upper portion of the stirring vane, an upward flow from the lower portion of the stirring vane can be promoted so as to develop a vertical circulating flow in the axial direction, resulting in achieving a quite high stirring efficiency.

With respect to the stirring device constructed as set forth above, comparative experiment was performed using the stirring devices constructed as illustrated in FIGS. 5A to 5D in order to check improvement of stirring efficiency of the fluid in the medium or high viscous range. Verification of effect was determined by adding hypo (sodium thiosulfate) solution to liquid to be stirred, to which iodine solution had been added and by utilizing a decoloring deoxidation reaction of iodine-hypo (sodium thiosulfate) solution. Decoloring variation as time goes was video recorded for determining the effect from the result of video recording.

As the stirring vessel, a transparent container having internal diameter of 30 cm was used. As the liquid to be stirred, a thick malt syrup solution (density of 1.36 g/cm$^3$) adjusted to have a viscosity of 2000 cps was used in amount of 20 litters. Stirring experiment has been performed under a condition where Reynolds number Re is about 50. Iodine solution and hypo (sodium thiosulfate) solution were adjusted to have viscosities equal to that of the liquid to be stirred.

Figure 5A:
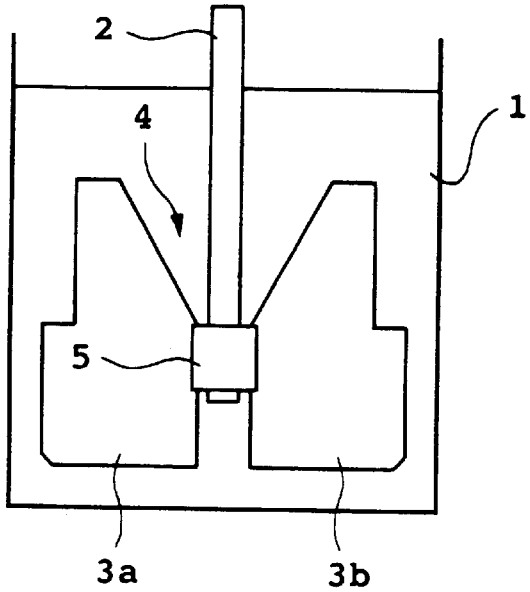
Figure 5B:
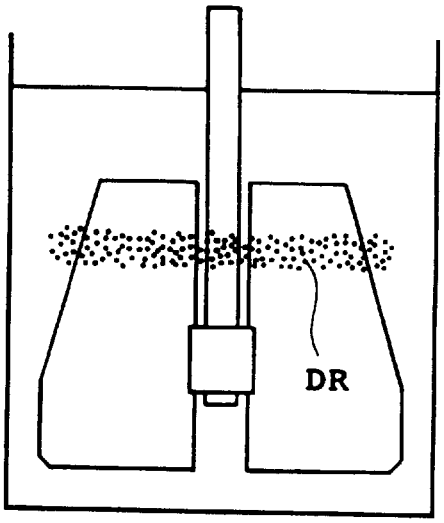
FIG. 5B PRIOR ART

There are shown results of decoloring experiments performed using the first embodiment of the stirring device according to the present invention as illustrated in FIG. 5A (no baffle plate is provided, stirring vane with V-shaped recess and the cut-out is used, height of the stirring vane is 20 cm, the maximum width of body of rotation of the stirring vane is 24 cm, height of the recess is 11 cm, the maximum width of the body of rotation of the recess is 15 cm, width and height of the cut-out in the vane plate are respectively 2 cm and 11 cm, height from the bottom surface to the liquid surface when the stirring vane is inserted into the stirring vessel is about 30 cm, and the distance from the lower end of the stirring vane and the bottom surface of the stirring vessel is 3 cm) and the conventional stirring device with the generally trapezoidal vane as illustrated in FIG. 5B (no baffle plate is provided, the stirring vane with the triangular cut-out in the upper portion of the outer edge is used, height of the stirring vane is 20 cm, the maximum width of the stirring vane is 24 cm, bottom edge length and height of the triangular cut-out of the vane plate are respectively 3 cm and 13 cm height from the bottom surface of the stirring vessel to the liquid surface when the stirring vane is inserted into the stirring vessel is about 30 cm, and the distance between the lower edge of the stirring vane and the bottom of the stirring vessel is 3 cm).

After 15 seconds from initiation of stirring, a mixture became substantially transparent in the former. On the other hand, doughnut-ring-like not well mixed portion DR was left at a portion of approximately ⅔ of the liquid surface height from the bottom surface of the stirring vessel in the latter, was observed. The position of the portion of approximately ⅔ of the liquid height from the bottom surface of the stirring vessel in the latter corresponds to the position of the center of the obliquely oriented elliptic flow line group in FIG. 4B set forth above.

Figure 5C:
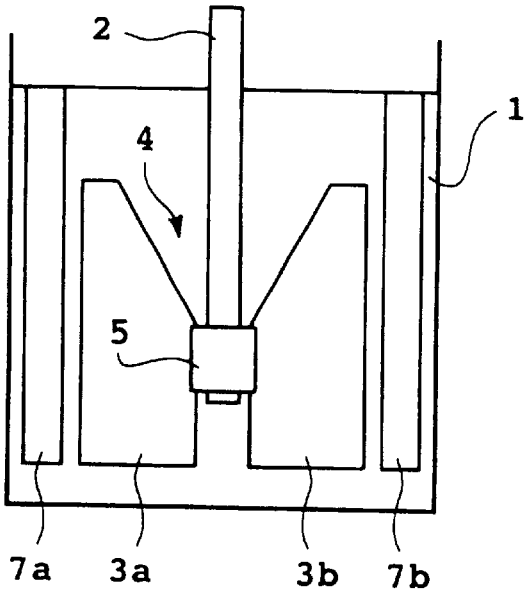
Figure 5D:
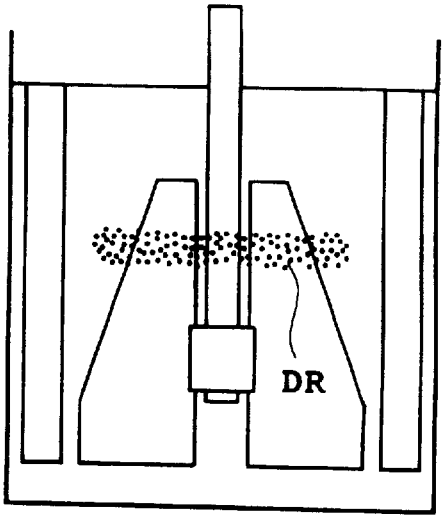
FIG. 5D PRIOR ART

There are shown results of decoloring experiments performed using the second embodiment of the stirring device according to the present invention as illustrated in FIG. 5C (baffle plates are provided, stirring vane with V-shaped recess is used, height of the stirring vane is 20 cm, the maximum width of body of rotation of the stirring vane is 17.6 cm, height of the recess is 11 cm, the maximum width of the body of rotation of the recess is 12.6 cm, height from the bottom surface to the liquid surface when the stirring vane is inserted into the stirring vessel is about 30 cm, and distance from the lower end of the stirring vane and the bottom surface of the stirring vessel is 3 cm, dimension of the baffle plate is 0.5 cm of thickness, 2.7 cm of width and 27 cm of length, and distance between the baffle plate and the stirring vessel is 1.5 cm) and the conventional stirring device with the generally trapezoidal vane as illustrated in FIG. 5D (baffle plates are provided, the stirring vane with the triangular cut-out in the upper portion of the outer edge is used, height of the stirring vane is 20 cm, the maximum width of the stirring vane is 17.6 cm, bottom edge length and height of the triangular cut-out of the vane plate are respectively 3 cm and 13 cm, height from the bottom surface of the stirring vessel to the liquid surface when the stirring vane is inserted into the stirring vessel is about 30 cm, and distance between the lower edge of the stirring vane and the bottom of the stirring vessel is 3 cm, dimension of the baffle plate is 0.5 cm of thickness, 2.7 cm of width and 27 cm of length, and distance between the baffle plate and the stirring vessel is 1.5 cm).

Similarly, after 15 seconds from initiation of stirring, a mixture became substantially transparent in the former. On the other hand, doughnut-ring-like not well mixed portion DR deformed due to influence of the baffle plates was left at a portion of approximately ⅔ of the liquid surface height from the bottom surface of the stirring vessel in the latter.

As set forth, superior stirring effect to be achieved by the stirring device of the present invention could be confirmed.

As set forth above, according to the present invention, owing to the presence of the V-shaped recess formed in the upper portion of the stirring vane, upward flow from the lower portion of the stirring vane can be promoted to grow vertical circulating flow in the axial direction to significantly improve stirring efficiency. Also, the present invention achieves low rotation speed and low power consumption with simple construction, in which flat vane plates are combined, to be easily manufactured and maintained.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A stirring device, comprising:

a vertical cylindrical stirring vessel;

a rotary shaft vertically extended within said stirring vessel for rotation; and a stirring vane constituted of two or more generally rectangular vane plates vertically and directly supported on said rotary shaft in symmetrical relation with each other with respect to the rotary shaft;

wherein a recess is formed on an upper edge of an uppermost portion of said stirring vane so as to form a conical recess about said rotary shaft when said stirring vane rotates, said uppermost of said stirring vane being closest to a liquid surface; and wherein a lower end of said stirring vane is arranged in the vicinity of a bottom surface of said stirring vessel.

2. The stirring device of claim 1, further comprising:

a rectangular baffle plate disposed between an outer edge portion of said stirring vane and an inner peripheral surface of said stirring vessel.

3. The stirring device of claim 2, wherein said stirring vane is a multi-stage vane including an upper vane and a lower vane.

4. The stirring device of claim 1, wherein said stirring vane is a multi-stage vane including an upper vane and a lower vane.

* * * * *